US005936579A

United States Patent [19]

Kapitsyn et al.

[11] Patent Number: 5,936,579

[45] Date of Patent: Aug. 10, 1999

[54] PLANAR ANTENNA ARRAY AND MICROSTRIP RADIATING ELEMENT FOR PLANAR ANTENNA ARRAY

[75] Inventors: Alexandr P Kapitsyn; Alexandr V Gritsaev; Sergei V Maiorov; Alexandr I Khudysh; Sergei L Milovanov; Gennady I Poldyaev; Nikolai N Privezentsev; Viktor T Antoshkin, all of Ryazan, Russian Federation

[73] Assignee: Zakrytoe Aktsionernoe Obschestvo Flant, Riazan, Russian Federation

[21] Appl. No.: 08/750,423

[22] PCT Filed: Jun. 9, 1995

[86] PCT No.: PCT/RU95/00129

§ 371 Date: Apr. 21, 1997

§ 102(e) Date: Apr. 21, 1997

[87] PCT Pub. No.: WO95/34104

PCT Pub. Date: Dec. 14, 1995

[30] Foreign Application Priority Data

Sep. 6, 1994 [RU] Russian Federation ..... 94022012
Sep. 6, 1994 [RU] Russian Federation ..... 94022013

[51] Int. Cl.[6] ..... H01Q 1/38

[52] U.S. Cl. ..... 343/700 MS; 343/829; 343/846; 343/713; 343/769; 343/770; 343/771; 343/767; 343/708

[58] Field of Search ..... 343/700 MS, 829, 343/846, 713, 769, 770, 771, 767, 708

[56] References Cited

U.S. PATENT DOCUMENTS

| | | | |
|---|---|---|---|
| 4,291,312 | 9/1981 | Kaloi | 343/700 MS |
| 4,605,932 | 8/1986 | Butscher | 343/700 MS |
| 4,692,769 | 9/1987 | Gegan | 343/700 MS |
| 4,766,440 | 8/1988 | Gegan | 343/700 MS |
| 5,241,322 | 8/1993 | Gegan | 343/700 MS |
| 5,661,494 | 8/1997 | Bondyopadhyay | 343/700 MS |

*Primary Examiner*—Robert H. Kim
*Assistant Examiner*—Layla G. Lauchman
*Attorney, Agent, or Firm*—Smith, Gambrell & Russell, LLP Beveridge, DeGrandi, Weilacher & Young; Intellectual Property Group

[57] ABSTRACT

A flat antenna array includes a screen plate, a conductive aperture plate which overlies the screen plate, and a dielectric sheet which is located between the aperture plate and the screen plate. Apertures in the screen plate define the locations of waveguides. A network of conductors is carried on the dielectric sheet. The conductors include stimulating elements which are aligned with the apertures. Each stimulating element includes first and second probes which have axes which cross each other and constitute a probe pair. A plurality of reflective elements are located above the dielectric sheet at locations which correspond to the apertures. A first output circuit connects together the first probes, a second output circuit connects together the second probes.

44 Claims, 8 Drawing Sheets

PLANAR ANTENNA ARRAY AND MICROSTRIP RADIATING ELEMENT FOR PLANAR ANTENNA ARRAY

FIELD OF THE INVENTION

The invention relates to radio technology, microwave technique, antenna-feeder units,—more specifically to strip antenna arrays used for the direct reception of satellite television broadcasts. At present time flat antenna used for the direct reception of satellite television broadcasts compatible with modern radio electronic equipment, with the efficiency of more than 0.7 and with aperture within 15 up to 30 waves, working frequency band up to 10% and with double linear and circular polarizations—is in the process of elaboration. Besides all of these antennas mentioned above must have simple construction, small thickness, high producing technology and same sizes and parameters, low value.

BACKGROUND OF THE INVENTION

The following sources of information are known:

1. European patent No. 0434268 publ. 26.06.91
2. U.S. Pat. No. 4,761,653, publ. 02.08.88
3. U.S. Pat. No. 4,833,482, publ. 23.05.89
4. European patent No. 0543519, publ. 25.05.93
5. Patent of Great Britain No. 2230902, publ. 23.02.90
6. European patent No. 0427479, publ. 15.05.91
7. U.S. Pat. No. 4,792,810, publ. 22.06.86

There are microstrip antennas for receiving two polarizations, with a dielectric sheet, on one side of which screen (grounding) metallization is arranged. On the other side, there are radiating elements and feeding systems for radiators of both polarizations.

Advantages of such antennas: simple construction—power circuits for radiators of both polarizations arranged on one surfaces of a dielectric sheet without intersection.

The main drawback of such antennas: big losses in power circuits. Besides that in constructions [1, 2] outputs of each power circuit of radiators arranged in different points of the dielectric sheet, it is impossible to use one converter with one input for signals of two polarizations. In antenna construction [3] there is one input for receiving two polarizations, but it has power circuits sequence, and with aperture of D=20 it is practically impossible to use them in antennas intended for the direct reception of satellite television broadcasts within frequency band 5–7% and with the efficiency 60%.

This way these antennas have obvious limits for their use in satellite television systems due to their narrow-band and bad elliptic.

The closest prior art to the proposed technical decision is a planar antenna array used for reception of satellite television broadcasts with two linear polarizations with a dielectric cover and two line sheets arranged with observance of definite distance, with a plurality of radiating apertures; two thin dielectric sheets—with power circuit for receiving signals of one (vertical) linear polarization on one of them and with power circuit for receiving signals of the other (horizontal) linear polarization on the other sheet; screen layer; power circuits; including exciter elements connected electromagnetically with radiating apertures on a conductive layer, power splitting elements and output probes connected with one waveguide output. With presence of low-noise converter with electronic polarization switcher connected through round input waveguide with antenna: with feed to converter one voltage—receiving of signal of one polarization available, with feed to converter another voltage receiving of cross polarization available [4]. But for this construction is obligatory: the presence of a metal plate with apertures dividing these sheets; four low dielectric insulators and many other references that arrange two dielectric sheets with intercross radiators and power circuits for these radiators between metal plates with apertures. Number of layers of such antennas together with protective cover, case, dielectric plates with power circuits, line plates with apertures, screen plates and so on is not less than 8–10. Besides that in order to escape diffraction petals of construction the radiator must be arranged on the distance not more than 0.9 I, where I is the length of wave in free space. And with aperture of antenna of D=20 the number of power dividers from input to radiator is not less than 8, which leads to considerable losses. More than that, as far as dielectric plates are arranged on different distances from upper conductive layer with radiating apertures and from bottom screen layer with apertures—this way conditions for exciting of radiating aperture by exciter elements of one sheet will differ from conditions for exciting of cross polarization by exciter elements of another sheet and they will not correspond to optimum. It is most clearly seen while receiving signals of right or left circular polarization. Output sections will also be on different distances. For receiving circular polarization signals into antenna construction [11] may be inserted quadature hybrid junctions that mast be arranged whether on dielectric sheets directly which will demand to insert new constructive elements in power circuits, because dielectric sheets arranged on certain distance from each other; or on antenna output which will also demand new costructive elements and will provide difficulties with placing of uniform antenna output in the center of antenna array and may reduce the number of radiators. Besides that quadature hybrid junctions have losses up to 0.2 . . . 0.5 dB and, due to their frequency independence, they may limit frequency band of antenna array with circular polarization.

The problem addressed by the invention is that of producing planar antenna array used for receiving signals with different polarization, that will be simple, reliable, highly technological and cheap and at the same time which is highly efficient across a broad frequency band. The decision is reached by reducing the number of radiating elements, which are additional reflectors of back radiation antennas (BRA), and by possibly arranging two power circuits with parallel feeding systems of exciter elements on one surfaces of one dielectric sheet with presence of one uniform output. The usage of BRA with the distances 2–3 between the centers of exciter elements makes conducting more simple and reduces the number of T-branches; it also obtains universal power circuit for different polarization signals that produces a whole number of variants of flat antenna with different parameters which differs only by the form of executing of exciter elements for circular or linear polarization. The aim is reached by the fact that in planar antenna array with different polarization containing arranged on definite distances protective dielectric cover, line plate with a plurality of radiating apertures, dielectric sheet and screen layer, exciter elements with output for signals of different polarization accordingly, two power circuits for the reception/transmission of signals of different polarization including feeding elements and output probes arranged in uniform waveguide output in the center of antenna array, on the inner surface of protective dielectric cover reflection elements array is arranged that are placed accordingly under the radiating apertures of line plate. The dielectric plate is located between screen layer and line plate-exciter elements with output for different polarization signals and two power circuits for the reception/transmission of different polarization signals arranged on one surface of dielectric sheet without intersection of conductors, and each of them has a pair of output probes arranged in such a way on plane of output waveguide cross-section that axes of each pair of output probes are perpendicular, and waveguide center is an axis of symmetry for output probes, half of exciter elements is connected to corresponding probes of pairs of output probes of power circuit and other half of exciter elements is connected to another corresponding probes of pairs of output probes corresponding power circuit. Exciter elements of power circuits are executed as circular polarization elements with outputs corresponding to left and right circular polarization, pairs of interaxes output probes intended for reception/transmission of right and left circular polarization accordingly; probes of waveguide cross-section arranged on the line bisecting between output probes intended for reception/transmission of linear polarization, and all the other probes—for reception/transmission of elliptical polarization with elliptic coefficient from 0 up to 1. Particularly, it is preferable to execute circular polarization elements as a pair of cross-probes, a loop arranged diagonal to them and galvanically connected with them, and a line which must be located not farther than 2/10 of wave length from the point of cross-probes' axis intersection and perpendicular to diagonal loop. Exciter elements may also be executed as to cross-probes, here the pair of interaxes of output probes will be intended for reception/transmission of vertical and horizontal polarization signals. It is worth-while that each reflection element of the array (which can be considered as additional reflector of each back radiation antenna) on the inner surface of protective dielectric sheet will be executed as a group of symmetrical rectangular conductive layer. It is more preferable that protective dielectric cover will be situated on the distance of 0.4–0.6 of wave length from the surface of the conductive layer with the plurality of radiating apertures. It is more preferable to execute screen layer with hollows disposed under radiating apertures of the conductive layer. It is worth-while to execute on outer surface of the conductive layer inner surface of protective dielectric cover accordingly borders and conductor lines that will divide these surfaces into cells, centers of these cells will correspond to centers of corresponding radiating apertures—and each reflection element on the inner surface of protective dielectric cover is placed in corresponding cells on this surface. It is worth-while to execute in the corner of each cell on conductive layer projections of geometrical figures, e. g.—9 squares, triangles, sectors, circles and so on.

Fulfillment of two power supply systems on one surface is known one dielectric payment without crossings in antenna with two polarizations [2, 3, 4, 5, 13, 14, 15]. However in a design [2, 3, 13, 14, 15] the outputs of each system are located in different places of sheet, that makes it impossible application of one converter with a general input for signals of two polarizations. In designs [4, 5, 13] the power supply systems are provided with a consecutive feed 15 stimulating elements, that excludes their use in antennas for direct reception of satellite TV—in frequency range 5–7% and with efficiency 60%.

The items of information on popularity of distinctive attributes, concerning applications of an array of reflecting elements on inner surfaces of a protective dielectric cover, located accordingly above radiating apertures of a conducting plate, and fulfillment of two power supply systems simultaneously for various polarizations (elliptic, two circular and/or two linear) on one surface of one dielectric sheet with parallel feed of stimulating elements at a general output, placed in the central part of array, is not available.

DETAILED DESCRIPTION OF THE INVENTION

Figure 1:
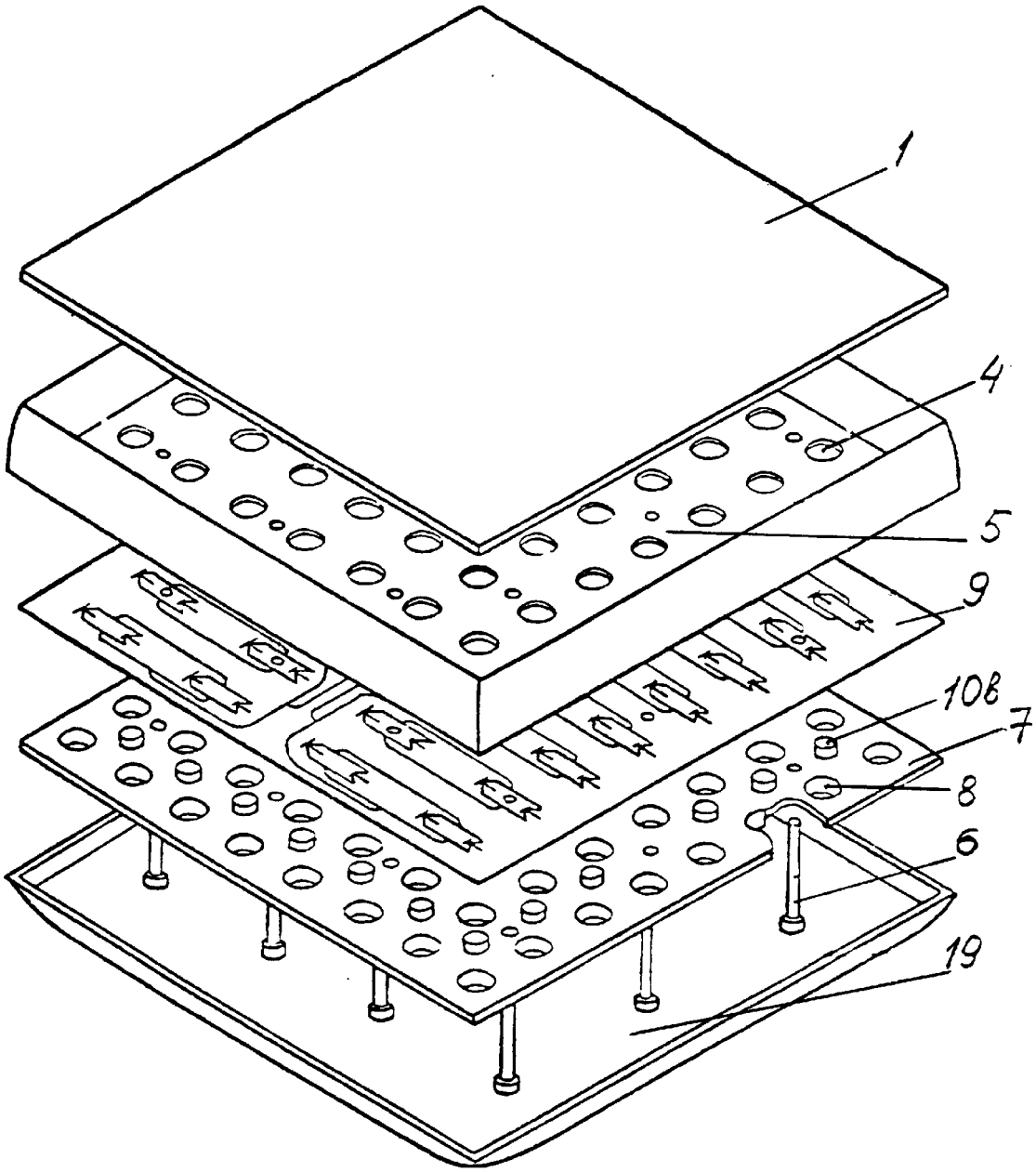
FIG. 1 represents a flat antenna array according to the invention, in a rectangular isometrical projection.
Figure 2:
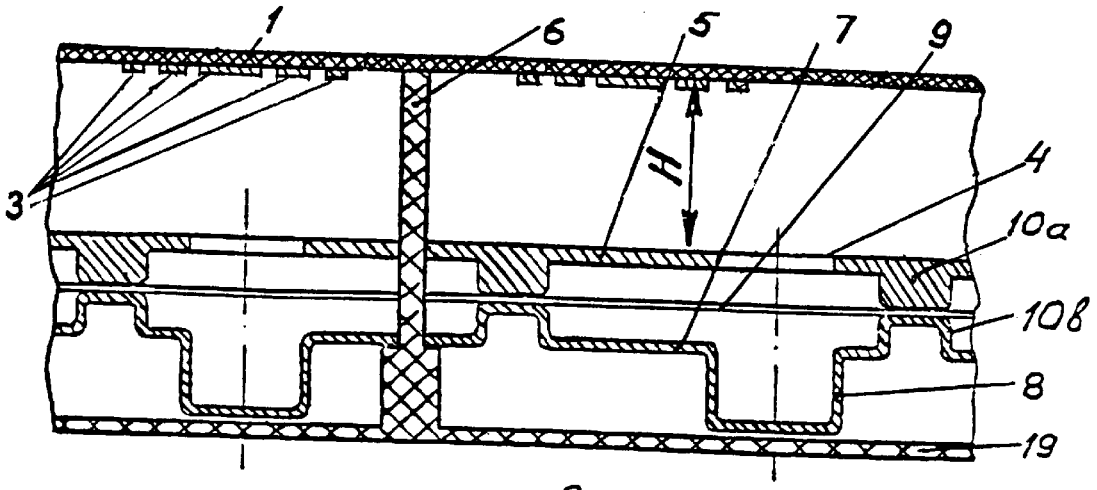
FIG. 2 represents a flat antenna array according to the invention in section.
Figure 3:
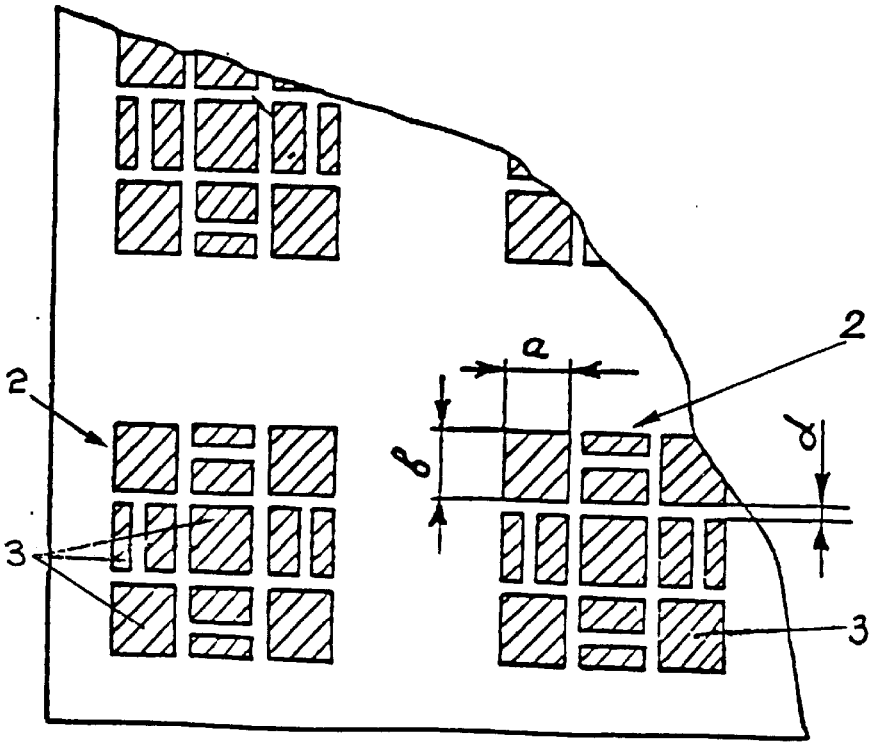
FIG. 3 represents a fragment of a reflecting element (additional reflector), inverted to elements of excitation.

The flat antenna array with various polarizations (FIGS. 1 and 2) contains established with observance of given distance a protective dielectric cover 1, on an inner surface of which an array of reflecting elements 2 is provided and each of which is carried out (FIG. 3) as group symmetric located conducting (metal) platforms 3 rectangular forms and is located above the appropriate radiating aperture 4 conducting plates 5 (FIG. 1. 2), which fastens on racks 6 on given distance H=0.4 . . . 0.6 the lengths of a wave from a surface of a protective dielectric cover 1, thus are formed antennas of back radiation, additional reflectors of which are reflecting elements 2 specified arrays, and basic reflector—appropriate zones around radiating apertures 4 conducting plates 5, screen plate 7, provided with cylindrical recesses 8, located under radiating apertures 4 conducting plates 5 and forming resonators for excitation of the specified apertures 4, dielectric sheet 9, located between conducting and screen plates 5, 7, provided with the appropriate ledges 10*a*, 10B for fixing a dielectric sheet 9 on given distance.

On one surface of a dielectric sheet 9 stimulating elements 11, located under radiating apertures 4 in a conducting plate 5 and electromagnetically connected with them, and two circuits of a feed reception/transmission signals of various polarizations without crossing conductors are placed.

Figure 11:
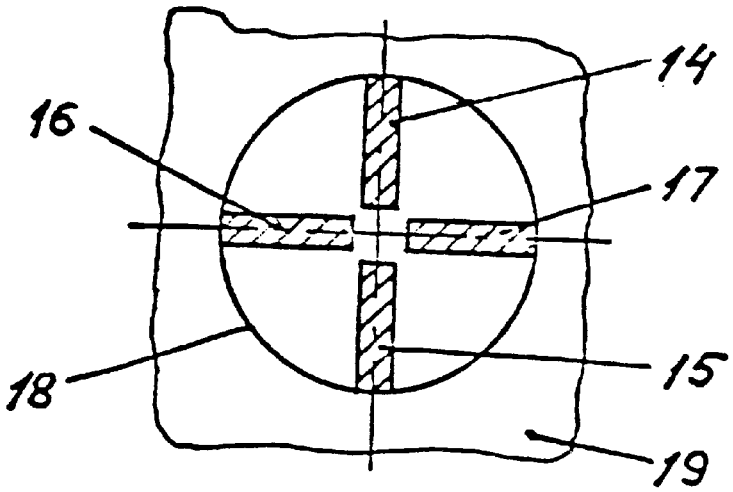
FIG. 11 represents a fragment of the bottom view on an antenna array - output aperture of a waveguide with output probes.
Figure 12:
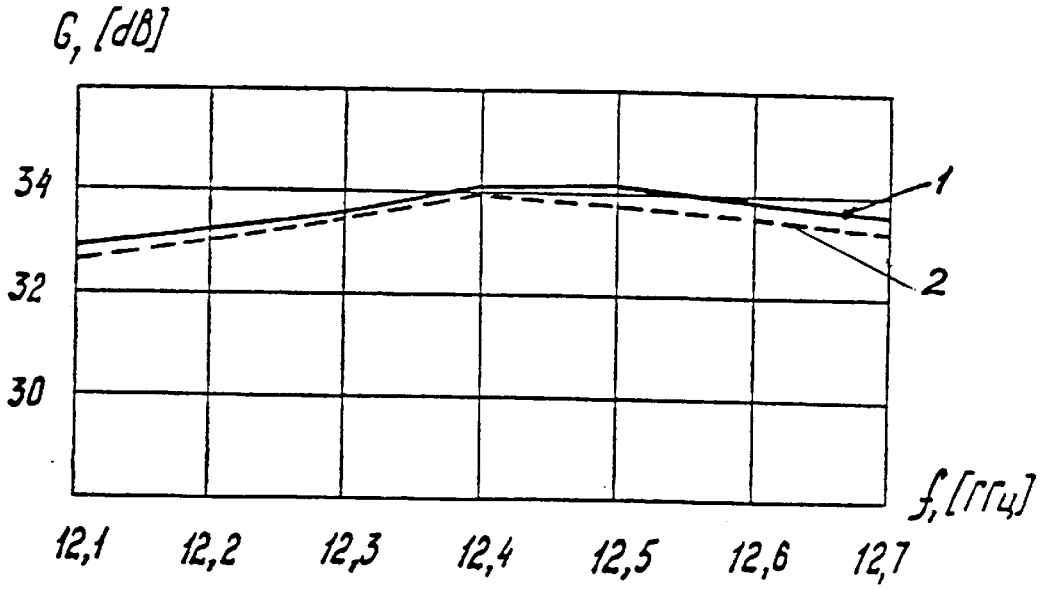
FIG. 12 is a graph showing the dependencies of factor of amplification of the antenna in a range of frequencies (curve 1—for signals of the right circular polarization, curve 2—for a signal of the left circular polarization.
Figure 13:
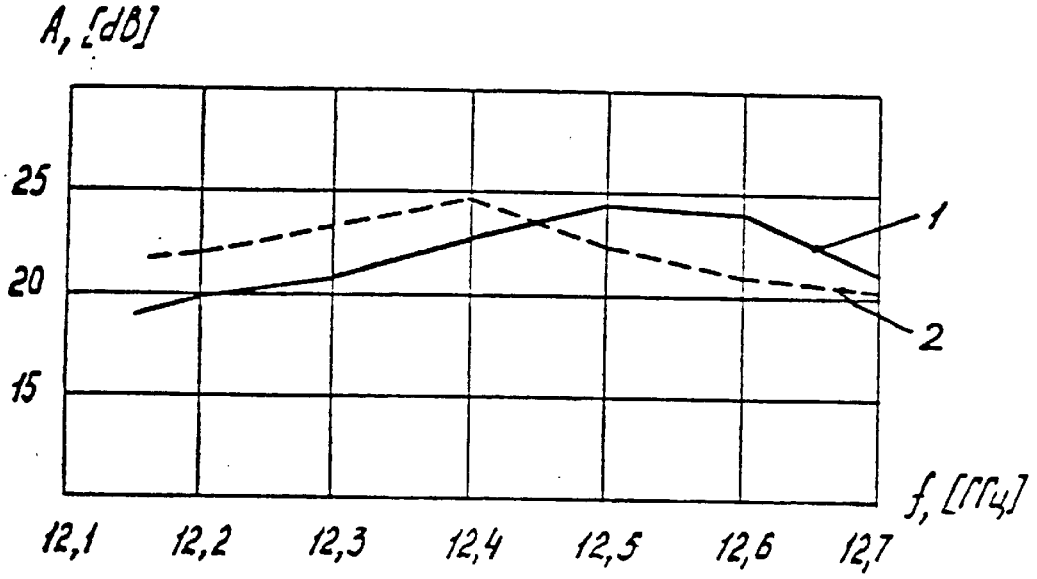
FIG. 13 is a graph showing the dependencies of an outcome on polarization in a range of frequencies (curve 1—for signals of the right circular polarization, curve 2—for a signal of the left circular polarization)
Figure 14:
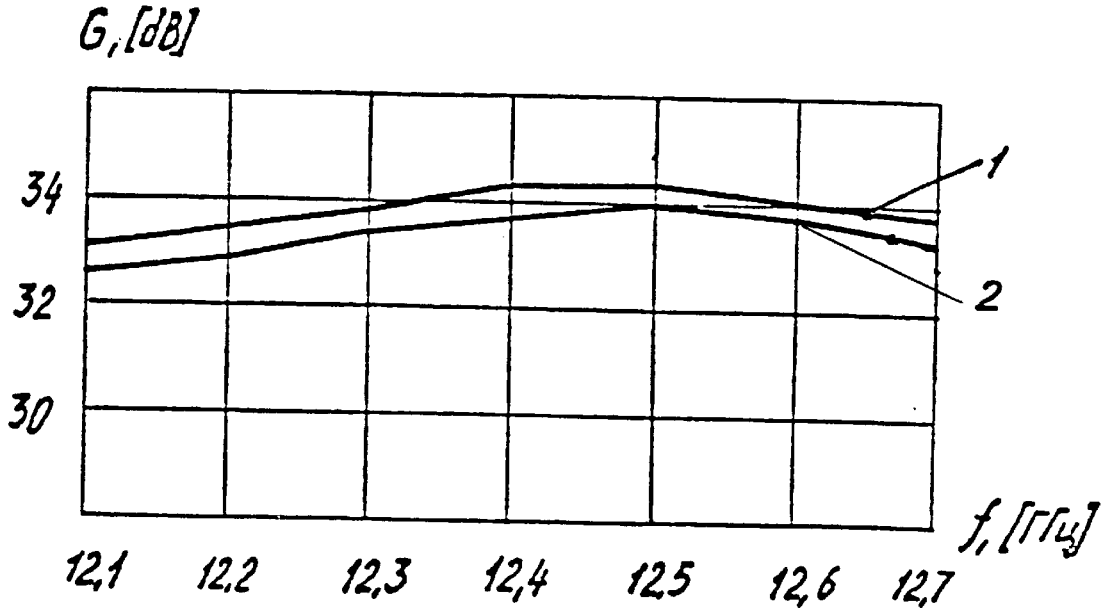
FIG. 14 is a graph showing the dependencies of factor of amplification of the antenna in a range of frequencies (curve 1—for signals of vertical polarization, curve 2—for a signal of horizontal polarization)
Figure 15:
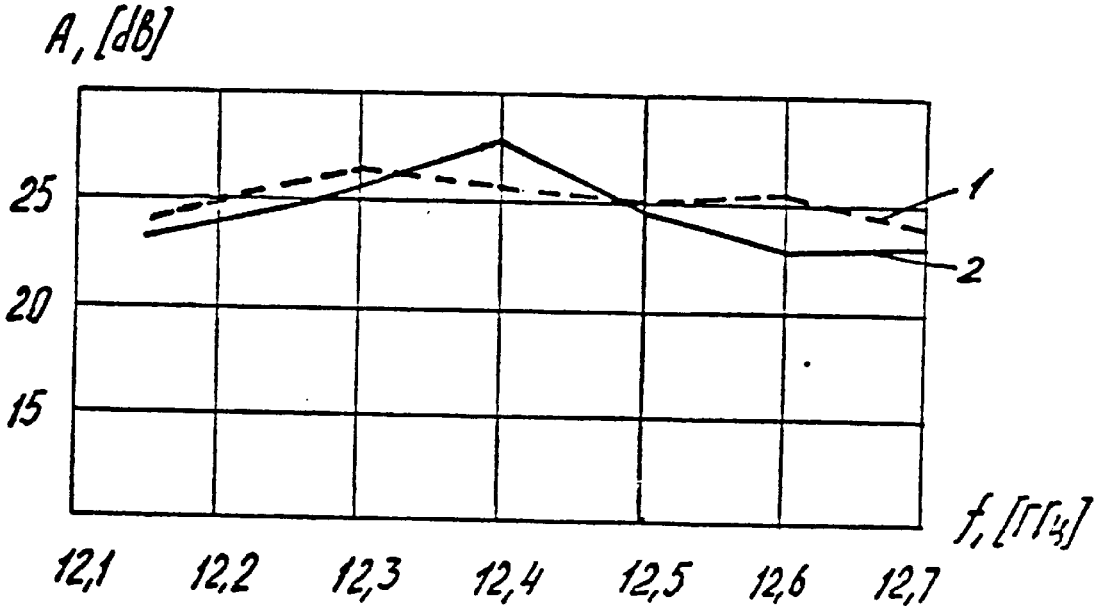
FIG. 15 is a graph showing the dependencies of levels of cross-polarizing frequencies making in a frequency range (curve 1—for signals of vertical polarization, curve 2—for a signal of horizontal polarization).

The specified circuits of a feed contain elements of feed (as pieces of strip lines 12*a*, 12B,12*c* and elements 13 division of capacity—T-figurative branches of capacity). FIG. 11 shows four probe outputs 14, 15, 16, 17 (two interaxes output of a probe 14, 15 - for one power supply system and two other interaxes output of a probe 16, 17—for other power supply system), located in a plane of cross section of an output waveguide 18 in such a manner that the axes of each pair of output probes (14, 15 and 16, 17) are cross, and the center of a waveguide 18 is an axis of symmetry for interaxes output probes (14, 15 and 16, 17). Half of stimulating elements 11 appropriate output for signals of various polarizations is connected to one output probes (for example, 14, 16) appropriate circuits of a feed, and other half of stimulating elements by appropriate output is connected to other output probes ( 15, 17) pairs of interaxes probes of the appropriate circuits of a feed. Stimulating elements 11 and the elements of a feed the power supply system are located symmetric concerning a waveguide 18, placed in a central part of the flat antenna of an array and being a general output, taking place through the bottom cover 19 antenna of an array. The free sites of a surface of a dielectric sheet 9 are intended under installation on the appropriate ledges 10*a*, 10B of a conducting plate 5.

Figure 4:
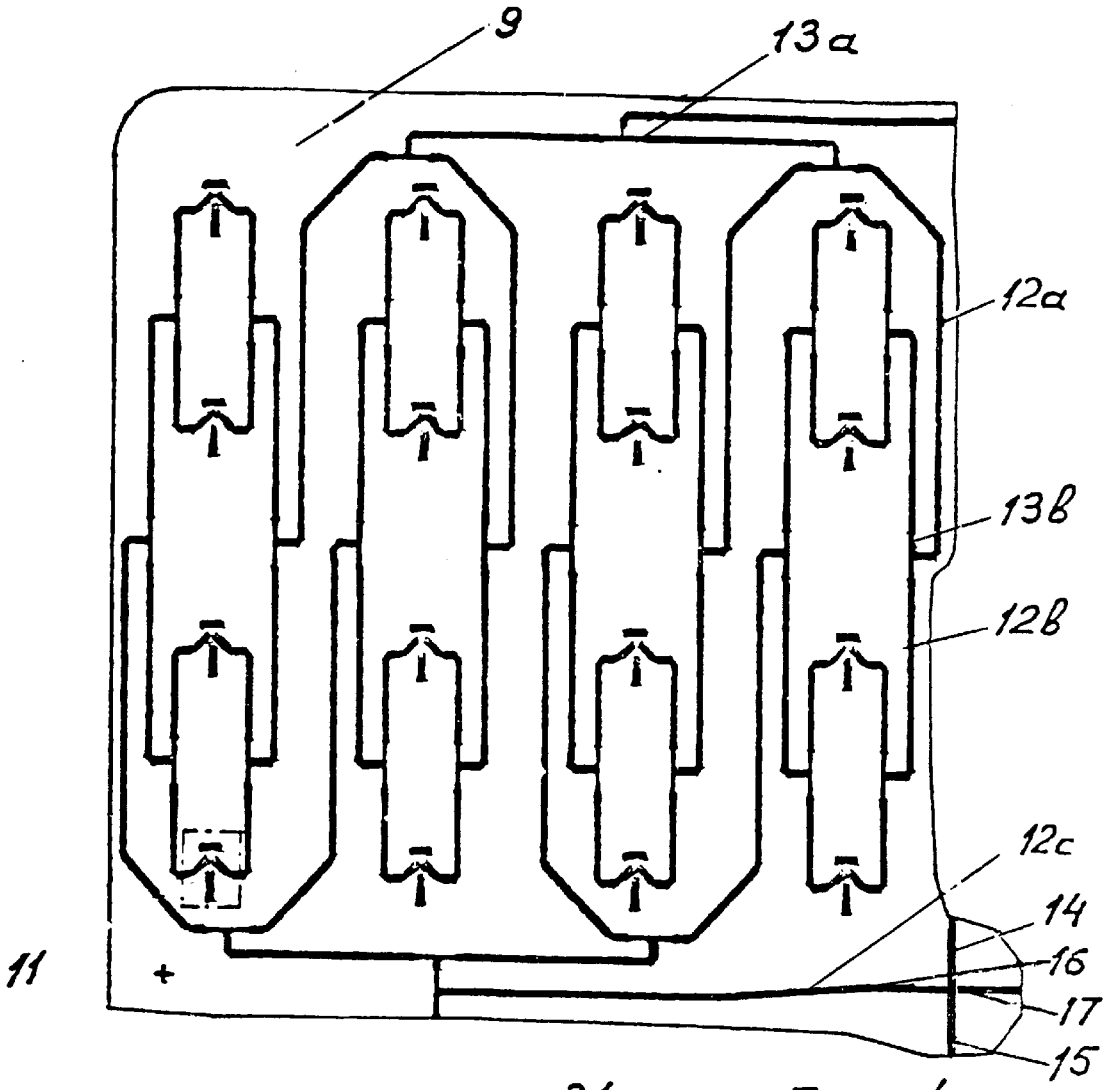
FIG. 4 represents a fragment of the power supply system of antenna array (dielectric sheet) with circular polarization.
Figure 5:
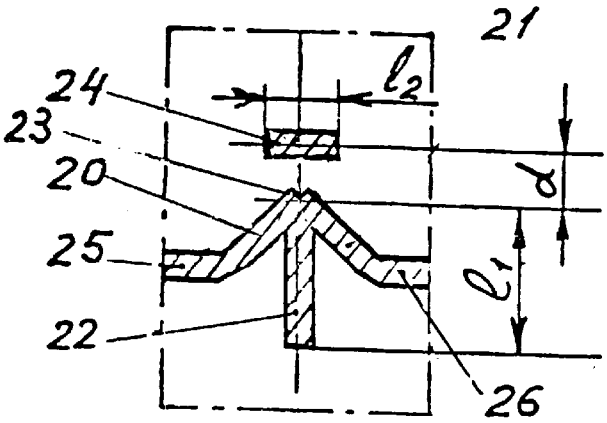
FIG. 5 represents a stimulating element—microstrip radiator with double circular polarization.
Figure 6:
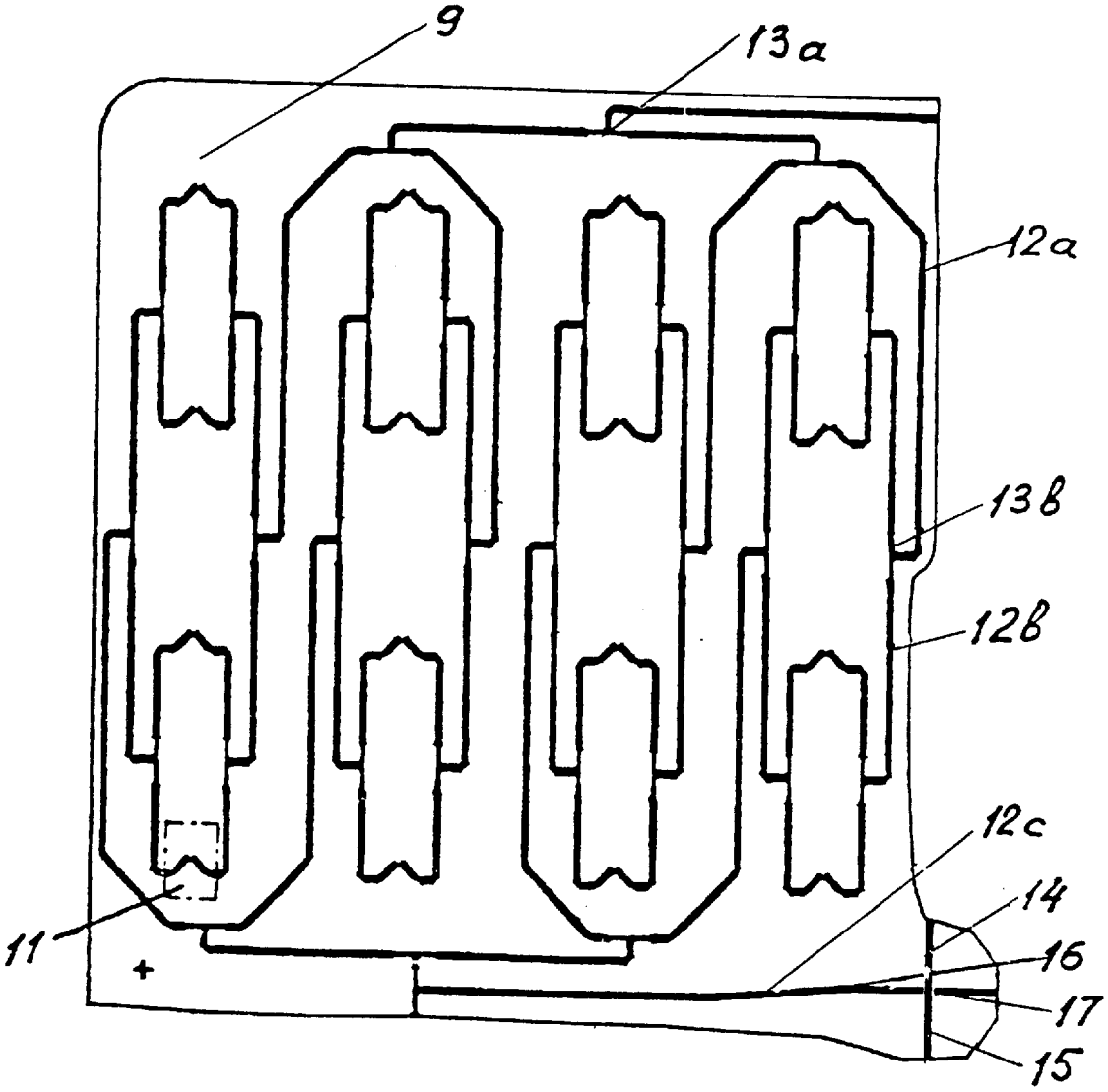
FIG. 6 represents a fragment of the power supply system of antenna array (dielectric sheet) with double linear polarization.
Figure 7:
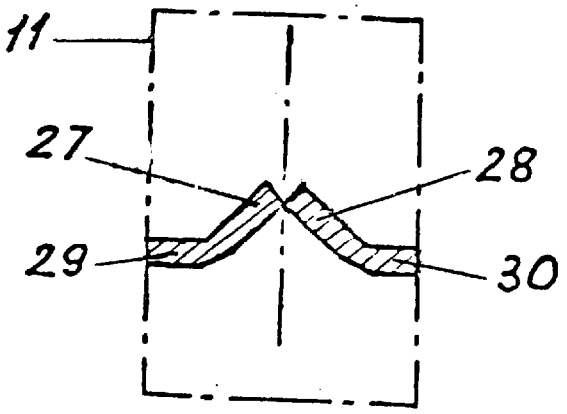
FIG. 7 represents a stimulating element—microstrip radiator with double linear polarization.

For construction of the antenna with various kinds of polarizations the stimulating elements 11 (FIGS. 6 and 7) are carried out as elements of circular polarization (in particular, shown on FIG. 5) with output 25, 26 according to the right and left circular polarization. Thus, in the antenna on a dielectric sheet 9 (FIG. 4), as is stated above, half of stimulating elements by 11 appropriate output 25, 26 for signals of the right and left circular polarization is connected through elements of a feed of 12*a*, 12B, 13 appropriate circuits of a feed, for example, to the appropriate output probes 16, 14 these systems, and other half of stimulating elements 11 output 25, 26 is connected through elements of a feed of 122*a*, 12B, 13 appropriate circuits of a feed to other output probes (17, 15) pairs of interaxes probes (14, 15 and 16, 17) appropriate circuits of a feed. Then the pair of interaxes output probes 16, 17 is intended for reception/transmission according to signals of the right circular polarization, the pair of interaxes output probes 14, 15 is intended for reception/transmission according to signals of the left circular polarization, and the zones of cross section of a waveguide 18, located on bisecting lines between output probes 14, 15, 16, 17 are intended reception/transmission linear polarizations, and other zones of the specified section—reception/transmission elliptic polarization with elliptical factor from 0 up to 1.

Stimulating elements of circular polarization (FIG. 5) can be a pair of orthogonal probes 20, 21 and located on a diagonal to them and galvanically connected with them of a loop of 22 lengths L=0.35 . . . 0.45 and on distance D not more than 0.2 from a point 23 crossings of axes of probes 20, 21 and perpendicularly diagonal loop 22 a strip of 24 lengths L=0.25 . . . 0.35 for necessary peak and phase distribution is located. Interrelation of orthogonal probes 20, 21 with a loop 22 and strip 24 at the chosen sizes and topology results in that, that at excitation of one probe the field in the friend, passive, is equal on amplitude to a field in active and is moved on a phase on a corner, approximately equal 90 that is conditions of the waves necessary for excitation of circular polarization are carried out. For construction of antennas with one kind of various polarizations, in particular, with double linear polarization, the stimulating elements 11 (FIG. 6) can be two orthogonal probes 27, 28 (FIG. 7) reception/transmission signals according to vertical and horizontal polarization. In such antenna on a dielectric sheet 9 (FIG. 1), similarly, half of stimulating elements 11 are connected by the appropriate output 29, 30 (FIG. 7) for vertical and horizontal polarization to the appropriate output probes 16, 14 each power supply system, and the other half of stimulating elements 11 are connected by the appropriate output for vertical and horizontal polarization to output probes 17, 15 each power supply system. Thus, the pairs of interaxes output probes 14, 15 and 16, 17 (FIG. 11) are intended for reception/transmission according to signals of vertical and horizontal linear polarization.

Figure 8:
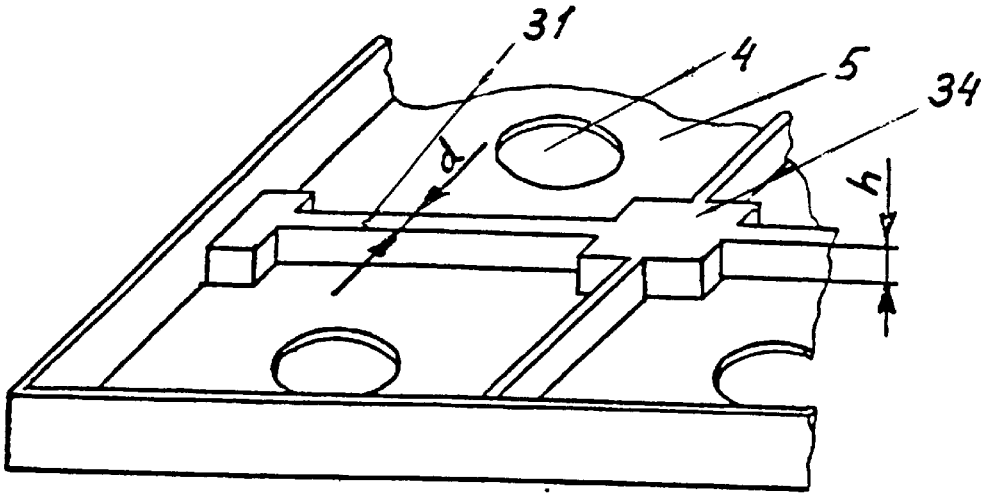
FIG. 8 represents borders, dividing antennas of back radiation.
Figure 9:
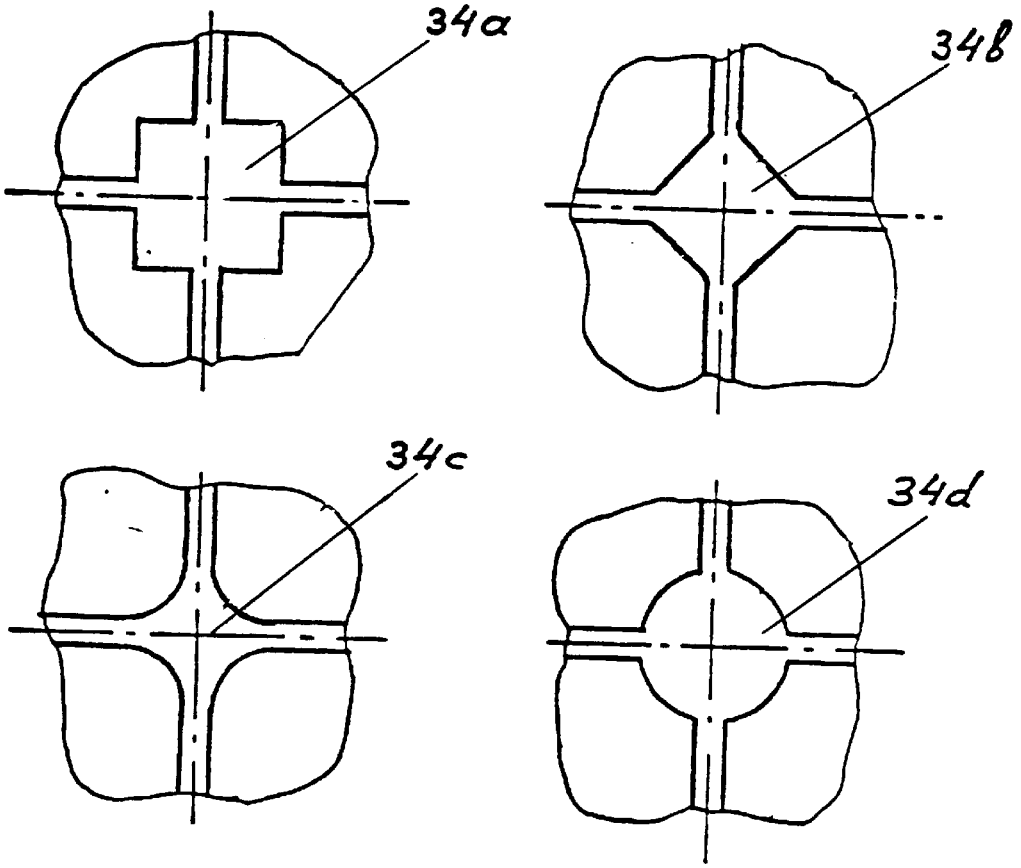
FIG. 9 represents the forms of ledges in corners of antennas of back radiation.
Figure 10:
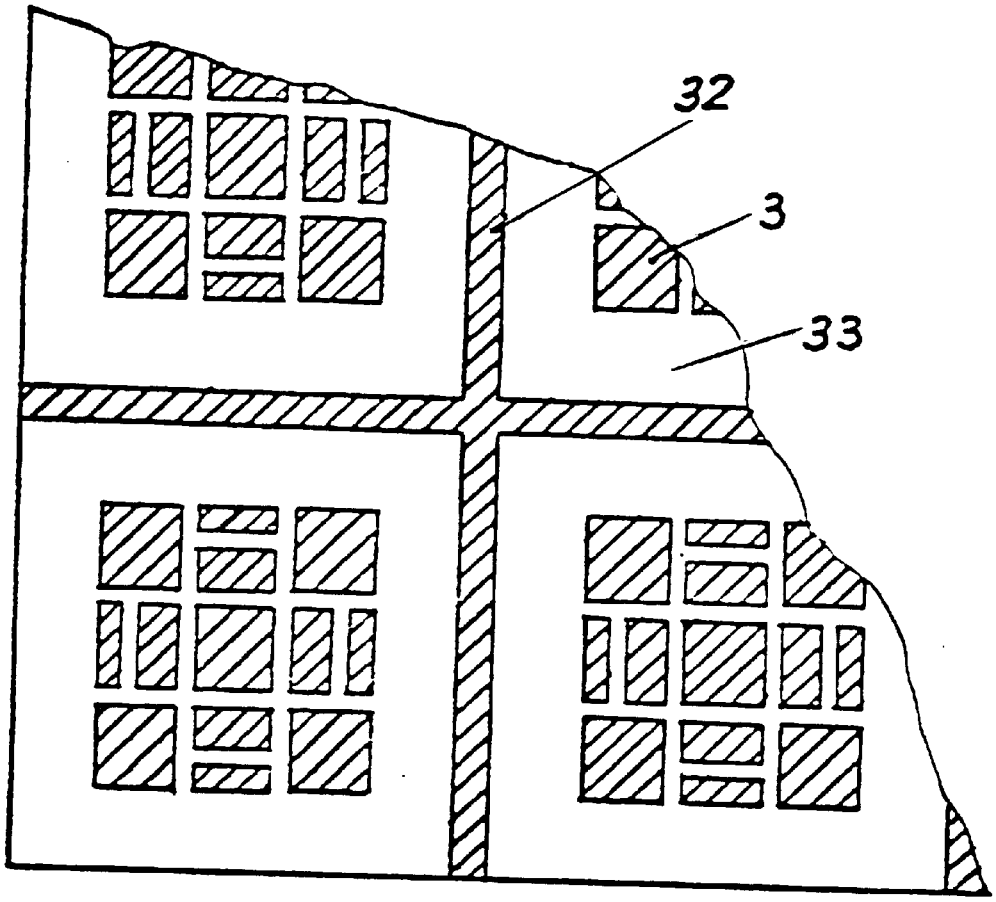
FIG. 10 represents a fragment of the inner part of a protective cover with additional reflectors located on it, divided into cells by conducting strips.

Expediently on an external surface of a conducting plate 5 (FIG. 8) and inner surface of a protective dielectric cover 1 (FIG. 1) to carry out according to a partition 31 (FIG. 8) of a conducting material of height h=0.2 . . . 0.3 and width no more than 0.2, conducting strips 32 of a width d=0.1 . . . 0.2, which divide these surfaces into cells 33 (FIG. 10), the centers of which coincide with centers of the appropriate radiating apertures, thus each array of reflecting elements 2 (FIG. 3) on an inner surface of a protective dielectric cover 1 is located in the appropriate cell 33 on this surface.

For increase of factor of amplification on a conducting plate in corners of each cell ledges 34 as geometrical figures, for example, squares 34*a*, triangles 34B, sectors 34*c*, circles 34*d* and so on are provided.

With the purpose of simplification of a design and increase of adaptability to manufacture the whole conducting plate 5 with partitions 31 (FIG. 8) and ledges 34 can be made from two connected of the top and bottom conducting plates with the appropriate radiating apertures 4. For fastening a dielectric sheet, partitions 31 and ledges 34 are provided on the top plate, and ledges 10*a* are provided on the bottom plate. Probably application and other known receptions of fixing of a dielectric sheet 9 between conducting and screen by plates 5, 7, ledges excluding application: probably application of linings between the specified plates 5, 7 of foarmed material or application of ledges, generated on the most dielectric sheet 9.

The antenna array works as follows. We shall consider a radiator of a is antenna array in a mode of transmission. At excitation of a pair of interaxes output probes 14, 15 signals through pieces of microstrip lines 12*a*, 12B and the dividers 13 capacity as T-figurative branchings act on the appropriate inputs(entrances) 26 stimulating elements 11. At fulfillment of stimulating elements 11 as elements of circular polarization (FIG. 5) at a feeding through an input 26 stimulating probes 21, this active probe through a diagonal loop 22 raises a passive probe 20. The additional connection between an active probe 21 and passive probe 20 is made through a conducting strip 24. Length of a diagonal loop 22, conducting strip 24 and distance of a strip from a point of crossing of orthogonal stimulating loops 20, 21 are chosen in such a manner that at a feeding of a stimulating probe 21 (active probe) in a stimulating probe 20 amplitudes of a vector of an electrical field, raised by a probe 21, is approximately equal to amplitude of a vector of an electrical field raised by a probe 20 (passive probe), and the phases of vectors differ on 90. As a result, a wave of the left circular polarization is raised. At excitation of other pair of interaxes output probes 16, 17 active there is the probe 20, passive probe 21, and the phases of vectors of an electrical field between fields raised by these probes differ on a minus 90 that is a wave of the right circular polarization is raised. The wave of circular polarization raises an electromagnetic field in radiators by the flat antenna of an array, which are antennas of back radiation (BRA). The electromagnetic field is raised in a cavity between the basic reflectors, the role of which is performed by a conducting plate 5 with stimulating apertures 4 and additional reflectors, located on the inner part of a protective cover 1.

As the wave of circular polarization can be presented as the sum of two orthogonal signals with linear polarization with identical amplitude and with phase shift 90, each additional reflector is a symmetric array of reflecting elements that the conditions of passage of each signal of linear polarization would be identical. In result on a surface of conducting platforms 3 additional reflectors and in backlashes between their edges is raised electromagnetic fields. The sizes of conducting platforms 3 reflecting elements 2 (additional reflectors) and, b (0.2 . . . 0.5) and the distances between them d=(0.1 . . . 0.3) get out experimentally. Thus the field on a radiating surface of each element of a is antenna array—antenna of back radiation, have the square aperture with the part from two up to two with two of two of halves, is close to equal-amplitude and in-phase.

As the power supply systems are carried out under the parallel circuit, all stimulating elements of a is antenna array are in-phase in a wide strip of frequencies, field on a surface of a is antenna array in phase and close to equal-amplitude, and operating ratio of a plane of an aperture comes nearer to unit.

By work of the antenna in a mode of reception in case of reception of a wave of the left circular polarization in view of a principle of reciprocity, the accepted waves in the return order consecutive raise an electromagnetic field and currents on conducting (metal) platforms 3 and in backlashes between these platforms 3, in stimulating apertures 4, in stimulating orthogonal probes 20 and 21, and then through pieces of microstrip lines 12*a*, 12B and dividers 13 capacity the signals act on a pair of interaxes output probes 14, 15, and on an output probe 14 signals from one half of stimulating elements 11, antenna located on that part act, where this probe 14 is located, and on an output probe 15—from other half of stimulating elements 11, antenna located on other part, where a probe 15 is located.

At reception of a wave of the right circular polarization the signals, passing on other system of a feeding, raise other pair of interaxes output probes 17, 16.

Except reception of signals of two circular polarizations the offered design of the antenna accepts signals of various polarizations—linear and elliptic polarization with factor of an elliptical from 0 up to 1.

For reception of double circular polarization a design of stimulating elements as two mutual - orthogonal probe 20, 21 can be applied, between which on a diagonal a loop galvanically connected to them of 22 lengths (0.35 . . . 0.45) and strip of 24 lengths (0.25 . . . 0.35) placed on distance no more than 0,2 from a point 23 crossings of mutual orthogonal probes perpendicularly to a loop 22, for reception of necessary peak and phase distribution is located.

Interrelation of orthogonal probes 20, 21 with a loop 22 and strip 24 at the chosen sizes and topology results in that at excitation of one probe the field in the friend, passive, is equal on excitation of a wave of circular polarization. At fulfillment of stimulating elements 11 on this topology, appropriate item 3 of the formula of the invention, at a feeding of two output probes 16, 17, laying on one cross axis of a round output waveguide 18, the antenna accepts (radiates) a wave of one circular polarization (for example, right), at a feeding of two other output probes 14, 15, orthogonal first, the antenna accepts a wave of the left circular polarization. Stimulating elements 11 and the circuit of a feeding on one dielectric sheet 9 are carried out in such a manner that the offered design of the antenna has wider functional opportunities in comparison with known, as it receives signals with any required polarization.

If for reception of signals the converter with one input is used and the entrance probe of the converter is located in a plane, taking place through a longitudinal axes of two output probes of the antenna, a signal of one of two circular polarizations is accepted. At turn of the converter with one input on 90 around longitudinal axis of a output waveguide 18 antenna is accepted a signal of other circular polarization. If the converter is located in such a manner that the plane, taking place through an entrance probe of the converter does not pass through output probes 14, 15 and 16, 17 antenna, there is the simultaneous reception on an entrance probe of signals of the right and left circular polarizations with amplitudes, dependent on a situation of an entrance probe of the converter.

If fields with the left and right circular polarization, as is known (see A. L. Drobkin, V. L. Zuzenko, A. G. Kislov. Antenna-feeder units, M.,"Soviet Radio",1974):

$$E_r = A_r e^{j(\omega t + \phi_1)} \quad (1)$$

$$E_l = A_l e^{-j(\omega t + \phi_2)} \quad (2)$$

Where $E_l$, $E_r$—vectors of an electrical field of the right and left rotation accordingly;

$A_l$, $A_r$—amplitudes of vectors of an electrical field;

$\phi_1$, $\phi_2$—initial phases of vectors of an electrical field.

The parameters of a polarizing ellipse a corner of an inclination are connected to the formulas (1) and (2) with dependences $$\chi = \frac{|A_r - A_l|}{A_r - A_l} \quad (3)$$

$$\alpha = \frac{\varphi_1 + \varphi_2}{2} \quad (4)$$

In case the reception probe of the converter is located on one of diagonals to output probes of the antenna $\phi_1$=45°, $\phi_2$=−45° of amplitudes of accepted signals $A_r$=$A_l$.

In this case $\chi$=0 that is polarisation is linear, and angle of an inclination of an axis of an ellipse $$\alpha = \frac{45° - 45°}{2} = 0$$

polarisation is horizontal. When the reception probe is located on other diagonal $\phi_1$=−45°, $\phi_2$=225°, $$\alpha = \frac{-45° + 225°}{2} = 90°$$

signal with vertical polarization is received. In case of installation between the antenna and converter of a controlled waveguide polarizer at installation of a plane of polarization from 0° up to 135° through 45° antennas accepts signals with any polarization: right circular-vertical left circular-horizontal, and in sections, different from (P1= K45 where K='0, 1, 2, 3—elliptic polarization with factor of an elliptical, determined by (3). It coordinates on polarization the transmitting antenna on the geostationary companion and offered reception antenna and to receive the maximum signal on an input of the converter.

For reception of signals with double linear polarization the stimulating element is provided by (FIG. 7) two mutual-orthogonal probes 27, 28. At excitation of a pair of interaxes output probes 14, 15 signals through pieces of microstrip lines 12*a*, 12B and the dividers 13 capacity act through the appropriate inputs 30 stimulating elements 11 on one (28) from a pair of mutual-orthogonal probes. The vector of an electrical field, raised by a probe 28 coincides with a longitudinal axis of this probe. As all probes appropriate to the given polarization are identical oriented and are raised in phase, the resulting vector of an electrical field, raised (or accepted) flat antenna by an array coincides on a direction with a longitudinal axis of a stimulating probe 28 and the flat antenna array has linear (for example, vertical) polarization. Passive in the given moment of time the stimulating probe 27 is located to a crossly active stimulating probe 28 and at a feeding of a probe 28 is not raised.

At excitation of a pair of interaxes output probes 16, 17 through elements of the appropriate power supply system the signals act on stimulating probes 27 and the flat antenna array has horizontal polarization.

If for reception of signals the converter with one input is used and the output probe of the converter is located in a plane, 14, 15, a signal of vertical linear polarization is accepted, at turn of the converter with one input on 90 around a longitudinal axis of a output waveguide 18 flat antenna of an array is accepted a signal of horizontal linear polarization.

For reception of more equal-amplitude and in-phase distribution of an electromagnetic field on a surface by the flat antenna of an array and, as a consequence, the increases of factor of amplification of the antenna, partitions 31 are provided on an external conducting surface of a plate 5, dividing this surface on cells, the centers of which coincide with centers of radiating apertures 4, and in corners of each cell ledges 34 as various geometrical figures are carried out: squares, triangles, circles, sectors etc.

Height h of partitions of 31 these cells, which are located on perimeter of the basic reflector of each antenna of back radiation, does not exceed thirty five 100-th lengths of a wave, i. e. the walls do not concern to an inner surface of a protective cover 1 and galvanic contact to an additional reflector is not required.

Even more levels peak distribution on a surface of an aperture of the antenna introduction on an inner surface of a protective dielectric cover of 1 conducting strips 32, dividing this surface on cells 33, the centers of which coincide with centers of the appropriate radiating apertures 4. In each such cell are located conducting (metal) platform 3 additional reflectors 2. The introduction of conducting strips 32 increases operating ratio of a plane of an aperture and factor of amplification by the flat antenna of an array, and also reduces diffraction petals.

The flat slot-hole antenna array with various polarizations, carried out according to the invention and used for direct satellite TV, at the sizes of the radiating aperture 456x456 mm and thickness of 26 mm has for circular polarization in a range of frequencies 12.2 . . . 12.7 GHz factor of amplification for the left polarization no less than 33.1 dB, thus the maximum meaning 34.1 dB, factor of amplification for the right circular polarization no less than 33.4 dB, and maximum meaning 34.3 dB.

Factor of an elliptical for the right and left circular polarization no more than 1.8 dB, that corresponds to an outcome on polarization no less than 20 dB.

The sizes, has for vertical polarization factor of amplification no less than 33.2 dB in a strip of frequencies 12.2 . . . 12.7 GHz, thus the maximum meaning 34.1 dB, for horizontal polarization—not less than 33.6 dB in a strip of frequencies, thus the maximum meaning 34.5 dB. An outcome on cross-polarization for vertical and horizontal polarization no less than 22 dB.

Correspondence Between Claims and FIGS

| Claims | FIGS. |
|---|---|
| 17, 33 | 1, 2, 4, 5, 6, 7, 10, 11 |
| 34 | 3, 10 |
| 35 | 2 |
| 36, 39 | 4, 5, 11 |
| 37, 40 | 5 |
| 38, 41 | 4, 7, 11 |
| 24, 44 | 3, 10 |
| 26, 46, 49 | 8, 10 |
| 27, 50, 47 | 2 |
| 28, 48, 51 | 2 |
| 29, 52 | 5 |
| 30, 53 | 5 |
| 31, 54 | 5 |
| 32, 55 | 2 |

We claim:

1. A flat antenna array, comprising, a screen plate;

an aperture plate which is conductive and overlies said screen plate, said aperture plate having a plurality of apertures through which transmitted or received radiant energy may pass;

a dielectric sheet located between said aperture plate and said screen plate;

a plurality of reflecting elements, said reflecting elements being located above the aperture plate at locations corresponding to said apertures;

said dielectric sheet carrying a network of conductors, said conductors including a plurality of stimulating elements each of which is located correspondingly to one of said apertures, each stimulating element including a first probe and a second probe which together constitute a probe pair, said probes of each probe pair having axes which cross each other;

a first output circuit which connects together the first probes on the dielectric sheet; and a second output circuit which connects together the second probes on the dielectric sheet.

2. A flat antenna array according to claim 1 wherein said reflecting elements are located on a dielectric cover which overlies said aperture plate and has an inner surface provided with an array of said reflecting elements.

3. A flat antenna array according to claim 1 wherein the screen plate has a plurality of recesses, said recesses being aligned with said apertures to form resonators associated with said waveguides.

4. A flat antenna array according to claim 1 wherein the first and second probes of each probe pair are orthogonally positioned relative to each other, a loop which is connected to said first and second probes and lies on a line which bisects said probe pair, and a conductor (24) which is perpendicular to the loop, whereby a pair of probes will receive/transmit signals of left and right circular polarizations.

5. A flat antenna array according to claim 4 wherein the axes of said probes of each probe pair intersect at a crossing point, and the conducting strip is spaced no more than two-tenths of a wavelength from the crossing point.

6. A flat antenna array according to claim 5 wherein the length of a loop is about 0.35 to 0.45 of a wavelength, and the length of the conducting strip is about 0.2 to 0.35 of a wavelength.

7. A flat antenna array according to claim 1 wherein, in each probe pair, the first and second probes are orthogonally positioned relative to each other in order to transmit/receive signals of vertical and horizontal linear polarization.

8. A flat antenna array according to claim 2 wherein each reflecting element on the dielectric cover is a symmetrically arranged group of rectangular reflecting areas.

9. A flat antenna array according to claim 2 wherein the dielectric cover is spaced from said aperture plate by a distance of 0.4 to 0.6 of a wavelength.

10. A flat antenna array according to claim 2 wherein partitions are provided on an external surface of the aperture plate and conducting strips are provided on said dielectric cover to provide cells, the centers of which substantially coincide with the centers of said apertures, each reflecting element being located in one of said cells.

11. A flat antenna array according to claim 10 wherein, at intersections where four cells meet, the partitions have a shape selected from the group consisting of square, diamond, sector or circle.

12. A flat antenna array according to claim 10 wherein said aperture plate is provided with projecting spacers which are positioned to maintain a fixed distance between the aperture plate and the dielectric sheet, said screen plate having projecting spacers which are positioned to maintain a fixed distance between said screen plate and the dielectric sheet.

13. A microstrip radiator comprising a screen plate;

an aperture plate which overlies said screen plate, said aperture plate having a plurality of apertures through which radiant energy may pass;

a sheet provided with a stimulating element which lies between the screen plate and the aperture plate;

said stimulating element having two orthogonal probes, a loop, and a conducting strip, said loop being located on a line which bisects said probes and being connected to said probes; said conducting strip being perpendicular to said loop.

14. A microstrip radiator according to claim 13 wherein said probes intersect at a crossing point, and said conducting strip is spaced no more than two-tenths of a wavelength from said crossing point.

15. A microstrip radiator according to claim 14 wherein the length of a loop is about 0.35 to 0.45 of a wavelength, and the length of a conducting strip is about 0.2 to 0.35 of a wavelength.

16. A microstrip radiator according to claim 13 wherein the screen plate has a plurality of recesses, said recesses being aligned with said apertures to form resonators associated with said waveguides.

17. The flat antenna array, carried out as multi-level structure, comprising, placed one under another, a dielectric cover, conducting plates with set of radiating apertures of a dielectric sheet and screen plates, thus multi-level structure will form set of microstrip radiators, containing stimulating elements with output for signals of various polarizations, and contains two power supply systems of microstrip radiators reception/transmission signals of various polarizations, including elements of a feed and output probes, located in a output waveguide, placed in center of an antenna array, wherein an array of reflecting elements, located above the appropriate radiating apertures of a conducting plate a dielectric sheet is entered is located between screen and conducting plates, thus stimulating elements of microstrip radiators and two power supply systems of microstrip radiators reception/transmission signals of various polarizations are placed on one surface of a dielectric sheet, and the output probes of each power supply system are carried out as a pair of interaxes probes, the axes of each pair of interaxes output probes are cross, the output probes are located in one cross section of a waveguide symmetric concerning an axis of a waveguide, a first one-half of stimulating elements by appropriate output is connected to one probes of pairs of interaxes output probes of the appropriate circuits of a feed, and a second one-half of stimulating elements by appropriate output is connected to other probes of the specified pairs interaxes-output probes of the appropriate circuits of a feed.

18. The flat antenna array of claim 17, wherein an array of reflecting elements is placed on an inner surface of a dielectric cover.

19. The flat antenna array of claim 17, wherein a screen plate is carried out with deepenings, located under a radiating aperture of a conducting plate and forming resonators for excitation of radiating apertures of a conducting plate.

20. The flat antenna array of claim 18, wherein stimulating elements (microstrip radiators) are carried out as a pair of orthogonal probes, direct corner located on a bisecting-line between them and loop galvanically connected to them and conducting platform placed perpendicularly to a loop, thus the pairs of interaxes output probes are intended for reception/transmission according to signals of the right and left circular polarizations, zone of cross section of a waveguide, located on bisecting-lines between output probes, are intended reception/transmission linear polarizations, and other zones of the specified section-reception/transmission elliptic polarization with factor of an elliptical from 0 up to 1.

21. The flat antenna array of claim 20, wherein a conducting platform is located a distance from a point of crossing of axes of probes which is no more than two tenth lengths of a wave.

22. Flat antenna array of claim 21, wherein length of a loop of 0.35–0.45 lengths of a wave, and length of a conducting platform of 0.2–0.35 lengths of a wave.

23. The flat antenna array of claim 17, wherein stimulating elements (microstrip radiators) are carried out as a pair of orthogonal probes, direct corner located on a bisecting-line between them and loop galvanically connected to them and conducting platform placed perpendicularly to a loop, thus the pairs of interaxes output probes are intended for reception/transmission according to signals of the right and left circular polarizations, zone of cross section of a waveguide, located on bisecting-lines between output probes, are intended reception/transmission linear polarizations, and other zones of the specified section-reception/transmission elliptic polarization with factor of an elliptical from 0 up to 1.

24. The flat antenna array of claim 23, wherein a conducting platform is located a distance from a point of crossing of axes of probes which is no more than two tenth lengths of a wave.

25. Flat antenna array of claim 24, wherein length of a loop of 0.35–0.45 lengths of a wave, and length of a conducting platform of 0.2–0.35 lengths of a wave.

26. The flat antenna array of claim 17, wherein stimulating elements are carried out as two orthogonal probes, thus the pairs of interaxes output probes are intended reception/transmission signals of vertical and horizontal linear polarization.

27. The flat antenna array of claim 18, wherein stimulating elements are carried out as two orthogonal probes, thus the pairs of interaxes output probes are intended reception/transmission signals of vertical and horizontal linear polarization.

28. The flat antenna array of claim 18, wherein each reflecting element of an array on an inner surface of a protective dielectric sheet is carried out as a group of symmetric located conducting platforms of the rectangular form.

29. The flat antenna array of claim 18, wherein a protective dielectric cover is located a distance from a surface of a conducting plate of from 0.4 up to 0.6 lengths of a wave.

30. The flat antenna array of claim 17, wherein an external surface of a conducting plate and inner surface of a protective dielectric cover are carried out according to a partition and conducting strips, dividing these surfaces on cells, centers of which coincide with centers of the appropriate radiating apertures, thus each reflecting element of an array on an inner surface of a protective dielectric cover is located in the appropriate cell on this surface.

31. The flat antenna array of claim 30, wherein on a conducting plate in corners of each cell are carried out ledges as squares, triangles, sectors or circles.

32. The flat antenna array of claim 30, wherein on reflecting and conducting plates are carried out ledges for fixing a dielectric sheet on given distance.

33. The flat antenna array of claim 18, wherein an external surface of a conducting plate and inner surface of a protective dielectric cover are carried out according to a partition and conducting strips, dividing these surfaces on cells, centers of which coincide with centers of the appropriate radiating apertures, thus each reflecting element of an array on an inner surface of a protective dielectric cover is located in the appropriate cell on this surface.

34. The flat antenna array of claim 33, wherein on a conducting plate in corners of each cell are carried out ledges as squares, triangles, sectors or circles.

35. The flat antenna array of claim 33, wherein on reflecting and conducting plates are carried out ledges for fixing a dielectric sheet on given distance.

36. The microstrip radiator, containing, placed one under other conducting plate with an other conducting a radiating aperture placed an one plate with a stimulating element carried out on it, including two orthogonal probes, and screen plate, wherein in a stimulating element are entered a loop and conducting platform, and the loop is located on a bisecting-line of a direct corner between probes and galvanically is connected to them, and the conducting platform is placed perpendicularly to a loop.

37. The microstrip radiator of claim 36, wherein a conducting platform is located a distance from a point of crossing of axes of probes no more than two tenth lengths of a wave.

38. Microstrip radiator of claim 37, wherein length of a loop of 0.35–0.45 lengths of a wave, and length of a conducting platform of 0.2–0.35 lengths of a wave.

39. The microstrip radiator of claim 36, wherein a screen plate is carried out with a deepening, located under a radiating aperture of a conducting plate and forming the resonator for excitation of radiating apertures of a conducting plate.

40. A flat antenna array, comprising, a screen plate;

an aperture plate which is conductive and overlies said screen plate, said aperture plate having a plurality of apertures through which transmitted or received radiant energy may pass;

a dielectric sheet located between said aperture plate and said screen plate;

said dielectric sheet carrying a network of conductors, said conductors including a plurality of stimulating elements each of which is located correspondingly to one of said apertures, each stimulating element including a first probe and a second probe which together constitute a probe pair, said probes of each probe pair having axes which cross each other;

a first output circuit which connects together the first probes on the dielectric sheet, and a second output circuit which connects together the second probes on the dielectric sheet;

said screen plate having a plurality of recesses which are located correspondingly with said apertures to form resonators.

41. A flat antenna array, comprising, a screen plate;

an aperture plate which is conductive and overlies said screen plate, said aperture plate having a plurality of apertures through which transmitted or received radiant energy may pass;

a dielectric sheet located between said aperture plate and said screen plate;

said dielectric sheet carrying a network of conductors, said conductors including a plurality of stimulating elements each of which is located correspondingly to one of said apertures, each stimulating element including a first probe and a second probe which together constitute a probe pair, said probes of each probe pair relative to each other and having axes which cross each other;

a first output circuit which connects together the first probes on the dielectric sheet, and a second output circuit which connects together the second probes on the dielectric sheet; a loop which is connected to said first and second probes and lies on a line which bisects said probe pair, and a conductor which is perpendicular to the loop, whereby a pair of probes will receive/transmit signals of left and right circular polarizations.

42. A flat antenna array according to claim 41 wherein the axes of said probes of each probe pair intersect at a crossing point, and the conductor is spaced no more than two-tenths of a wavelength from the crossing point.

43. A flat antenna array according to claim 42 wherein the length of a loop is about 0.35 to 0.45 of a wavelength.

44. A flat antenna array, comprising, a screen plate;

an aperture plate which is conductive and overlies said screen plate, said aperture plate having a plurality of apertures through which transmitted or received radiant energy may pass;

a dielectric sheet located between said aperture plate and said screen plate;

a dielectric cover which overlies said aperture plate and has an inner surface Provided with an array of reflecting elements, each reflecting element being a symmetrically arranged group of rectangular reflecting areas;

said dielectric sheet carrying a network of conductors, said conductors including a plurality of stimulating elements each of which is located correspondingly one of said apertures, each stimulating element including a first probe and a second probe which together constitute a probe pair, said probes of each probe pair having axes which cross each other;

a first output circuit which connects together the first probes on the dielectric sheet, and a second output circuit which connects together the second probes on the dielectric sheet.

* * * * *